US009564674B2

(12) United States Patent
Dai

(10) Patent No.: US 9,564,674 B2
(45) Date of Patent: Feb. 7, 2017

(54) WINDOW ANTENNA CONNECTOR WITH IMPEDANCE MATCHING

(71) Applicant: David Dai, Novi, MI (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 0 days.

(21) Appl. No.: 14/171,204

(22) Filed: Feb. 3, 2014

(65) Prior Publication Data

US 2015/0222242 A1 Aug. 6, 2015

(51) Int. Cl.

| | |
|---|---|
| ***H01Q 1/12*** | (2006.01) |
| ***H01P 1/04*** | (2006.01) |
| ***H01Q 1/32*** | (2006.01) |

(52) U.S. Cl.

CPC ..... *H01Q 1/1271* (2013.01); *H01P 1/047* (2013.01); *H01Q 1/325* (2013.01)

(58) Field of Classification Search

CPC .... H01Q 1/325; H01Q 1/3291; H01Q 1/1271; H01P 1/04; H01P 1/047

USPC ..... 343/713; 333/33, 260

See application file for complete search history.

(56) References Cited

U.S. PATENT DOCUMENTS

| | | | | |
|---|---|---|---|---|
| 4,715,928 | A | 12/1987 | Hamby | |
| 5,278,572 | A | 1/1994 | Harada et al. | |
| 5,363,114 | A | 11/1994 | Shoemaker | |
| 5,534,879 | A | 7/1996 | Braun et al. | |
| 5,556,300 | A | 9/1996 | Parker | |
| 5,596,335 | A | 1/1997 | Dishart et al. | |
| 5,867,128 | A | 2/1999 | Sauer | |
| 5,926,141 | A | 7/1999 | Lindenmeier et al. | |
| 6,164,984 | A | 12/2000 | Schreiner | |
| 7,137,828 | B2 | 11/2006 | Yu et al. | |
| 8,077,100 | B2 | 12/2011 | Baranski | |
| 2009/0128431 | A1* | 5/2009 | Martin | B32B 17/10036 343/713 |
| 2012/0098716 | A1* | 4/2012 | Dai | H01Q 13/10 343/713 |

* cited by examiner

*Primary Examiner* — Benny Lee
(74) *Attorney, Agent, or Firm* — Cohen & Grigsby, P.C.

(57) ABSTRACT

A connector for an automotive windshield antenna includes a thin trace portion that is electrically equivalent to a series inductor and a wide trace portion that is electrically equivalent to a shunt capacitor. The capacitor and the inductor form a matching LC network that is adjustable to match antenna impedance and transmission line impedance.

28 Claims, 4 Drawing Sheets

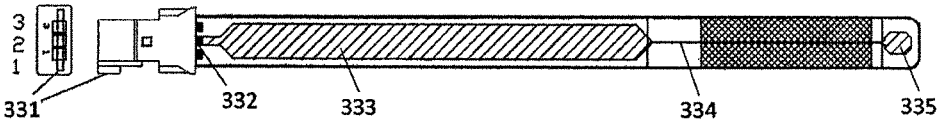
FIG. 4B
FIG. 4A
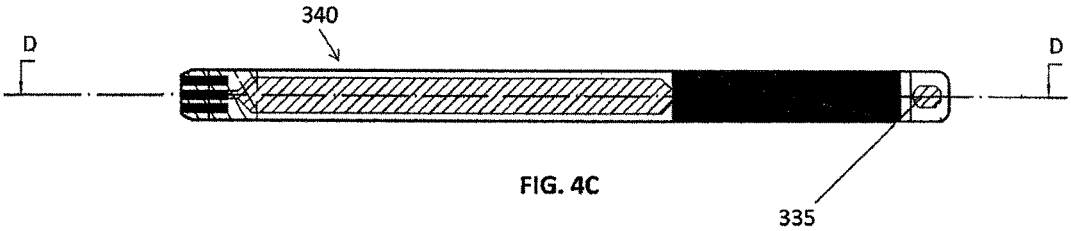
FIG. 4C
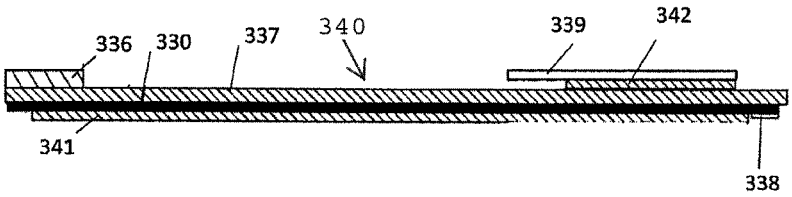
FIG. 5

WINDOW ANTENNA CONNECTOR WITH IMPEDANCE MATCHING

TECHNICAL FIELD

The presently disclosed invention is generally related to connectors for vehicle antennas and, more specifically, to connectors for use in connection with laminated glass antennas such as a wire antenna that is embedded in a window laminate or a slot antenna that is located at the perimeter of a panel of window glass that is coated with an infrared reflective thin film.

BACKGROUND OF THE INVENTION

Vehicle window antennas that include embedded wires or silver print antennas in the rear window and windshield have been used in the prior art as an alternative to conventional whip antennas and roof mounted mast antennas. More recently, vehicle windows that are coated with an infrared reflective, thin metal film also have been used in connection with vehicle antennas. In the case of laminated glazing, the glass is formed of outer and inner glass plies that are bonded together by an interposed layer, preferably of a standard polyvinylbutyral or similar plastic material. The antenna may be screen printed on one of the inner surfaces of the glass plies using conductive ink such as silver paste or, alternatively, the antenna may be a thin conductive wire that is embedded in one of the surfaces of the interlayer.

There have been two ways to feed an antenna that is located in a laminated glazing—galvanic feed or coupling feed. The most common method has been direct feed by a galvanic connection through a flexible, flat connector. The flat connector comprises a conductor trace that is printed on a dielectric layer and covered with a dielectric tape. One end of a flat cable or film connector is soldered to an antenna wire or conductive printed pad and remains in the glazing structure when the window is laminated. The other end of the connector wraps over the outside edge of the glazing to connect to the exterior vehicle electronics.

Another method for connecting to antennas that are located in a laminated glazing has been a coupling feed. The coupling feed eliminates the need to solder the antenna to a connector or to pass a connector beyond the perimeter edge of glass to feed the antenna. For example, U.S. Pat. No. 8,077,100B2 to Baranski discloses an antenna coupling apparatus that transfers the antenna signal from an antenna wire situated inside laminated glass to a connector on an exterior surface of the glass. However, the Baranski antenna connector is based on transmission line coupling theory so that it cannot meet wide frequency band requirements such as for TV antennas that have as many as five frequency bands.

For efficient performance, the impedance of an antenna must be matched to the impedance of the transmission line that carries signals to and from the antenna. Any mismatch in impedance between the antenna and the transmission line will increase the standing wave that is present on the transmission line when transmitting or reduce the signal present on the transmission line when receiving. Such impedance matching must occur physically at the point of interconnection between the laminated glass antenna and a coaxial cable or an antenna amplifier input. Preferably, the impedance matching occurs in the FM, TV or other operating frequency bands where the input impedance is often 50Ω. WIPO Patent Application WO/2012/136411 to Bernhard discloses a flat antenna connector with a conductive shield on top of the antenna trace to increase capacitive coupling to the ground to improve signal transmission and reduce interference. The coupling capacitance acts as a high pass filter that improves the TV antenna performance at the UHF band (470 MHz-860 MHz). However, that design tends to degrade antenna performance at the lower frequency band such as the TV VHF band from 47 to 240 MHz.

With rapid growth in the demand for vehicle electronics, more and more antennas are being integrated to vehicles. Even though traditional mast or whip antennas have provided satisfactory performance in the past, often they are no longer preferred because they are considered to detract from vehicle aesthetics. With a greater number of antennas being integrated into window glazing, it was seen that there was a need in the prior art for an antenna connector that provided impedance matching to the laminated glass antenna. Such an antenna would be advantageous in comparison to a standard antenna connector.

SUMMARY OF THE INVENTION

In accordance with the presently disclosed invention, an antenna connector for use with laminated glass antennas provides wideband impedance matching to improve antenna performance. The antenna connector is compatible with embedded wiring, silver print, or IR coated antennas. The antenna connector is adapted to receive signals from an antenna and provides impedance matching to an electronic device. The antenna connector includes a flexible insulating substrate, a transmission line that is printed on the insulating substrate to conduct a signal between the antenna and the electronic device, and an insulating cover tape that isolates the transmission line from electrical ground.

The transmission line includes a solder pad that is laminated inside the glass and galvanically connected to the antenna, a thin conductive trace portion that is partially inside the laminated glazing and partially outside the glazing and taped to the exterior surface of the glass, a wide conductive trace portion that is capacitively coupled to the vehicle ground frame, and a terminal portion that is connected to an electronics device that is mounted on the metal frame of the vehicle.

In the presently preferred embodiment, the thinner portion of the transmission line is equivalent to a series inductor and the wider portion of the transmission line which is coupled to the vehicle ground frame is equivalent to a shunt capacitor. The inductor and capacitor form an LC matching network between the antenna and the coaxial cable or vehicle electronic device. The inductance and capacitance of the LC network is adjustable by changing the trace length and width of each portion of the transmission line so as to match the impedance of the electronic device to the impedance of the antenna at the selected frequency range for which the antenna is designed.

BRIEF DESCRIPTION OF THE DRAWINGS

For a more complete understanding of the presently disclosed invention, reference should be had to the embodiments illustrated in greater detail in the accompanying drawings and described below by way of examples of the invention. In the drawings:

FIG. 4A is a plan view of an antenna connector that incorporates features of the presently disclosed invention with the tape removed and showing the engagement of the connector with the pin housing;

FIG. 4B is an end view of the pin housing shown in FIG. 4A;

FIG. 4C is a plan view of the antenna connector with the pins and pin housing removed;

FIG. 5 is a section view taken along line D-D in FIG. 4C;

DETAILED DESCRIPTION OF THE INVENTION

Figure 1:
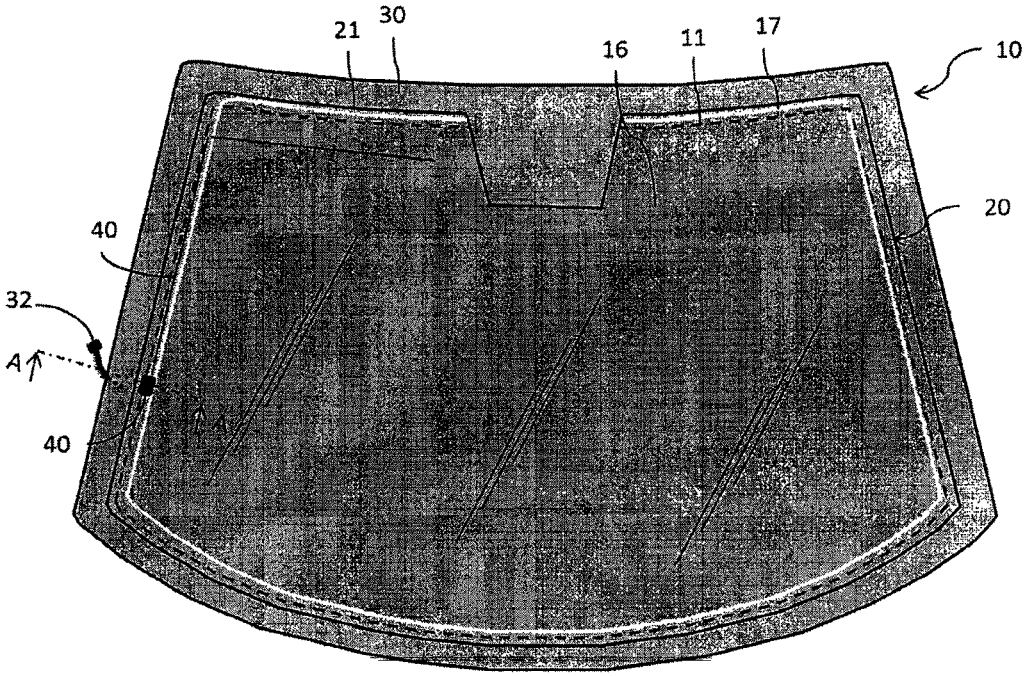
FIG. 1 is a plan view of a windshield antenna that incorporates features of the presently disclosed invention.
Figure 2:
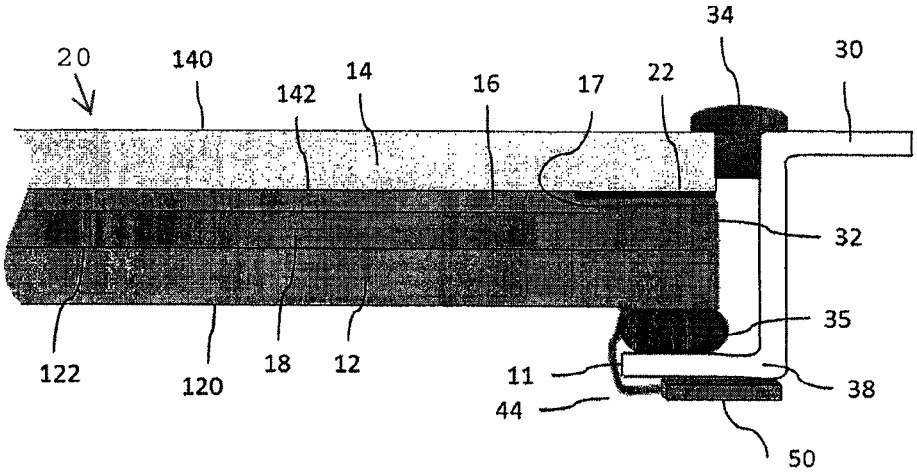
FIG. 2 is a sectional view taken along line A-A in FIG. 1 in accordance with the presently disclosed invention and illustrating an antenna feeding structure for an IR coated antenna.

FIG. 1 is a plan view of antenna windshield 10 and its associated structures incorporating the features of the presently disclosed invention. FIGS. 1 and 2 show that windshield 20 is surrounded by a metal frame that has a window aperture defined by body window edge 11. The outer edge 21 (FIG. 1) of windshield 20 overlaps an annual flange 38 (shown in FIG. 2) of body 30 to provide a windshield for vehicle body 30. As shown in FIG. 2, an annular sealing member such as glue bead 35 is located between windshield 20 and flange 38, and a molding 34 bridges the outer gap between the body 30 and windshield 20.

As shown in FIG. 2, windshield 20 is a laminated vehicle windshield that is formed of outer and inner glass plies 14 and 12. Glass plies 12 and 14 are bonded together by an interposed layer 18, preferably of a standard polyvinylbutyral or similar plastic material. Outer glass ply 14 has an outer surface 140 (conventionally referred to as the number 1 surface) on the outside of the vehicle and an inner surface 142 (conventionally referred to as the number 2 surface) Inner glass ply 12 has an outer surface 122 (conventionally referred to as the number 3 surface) on the inside of windshield 20 and an inner surface 120 (conventionally referred to as the number 4 surface) that is internal to vehicle interior. The interlayer 18 is between surfaces 142 and 122.

As shown in FIG. 2, windshield 20 may include an obscuration band 22 of opaque ink that is screen printed onto a glazing and subsequently fired around the perimeter of the window glass. The purpose of obscuration band 22 is to conceal the antenna elements and other apparatus located near the glass edges.

FIGS. 1 and 2 show that windshield 20 may further include a wire antenna 40 (FIG. 1) and an electro-conductive element 16 that occupies the daylight opening of the transparency. Element 16 is preferably a transparent electro-conductive coating that is applied to surface 142 of the outer glass ply 14 (as shown in FIG. 2) or to surface 122 of the inner glass ply 12, as is well known and understood by those skilled in the art. The coating may be a single or multiple layer metal-containing coating as disclosed, for example, in U.S. Pat. No. 3,655,545 to Gillery et al.; U.S. Pat. No. 3,962,488 to Gillery and U.S. Pat. No. 4,898,789 to Finley.

The conductive coating 16 has a peripheral edge 17 that is spaced laterally inward from the vehicle body window edge 11 to define an annular slot antenna between edge 11 and coating edge 17. The slot antenna may be fed directly by an antenna connector 32 as illustrated in FIGS. 1 and 2. One end of connector 32 is connected to coating edge 17 and laminated between outer ply 14 and interlayer 18. The connector 32 exits the perimeter edge of the windshield 20 and is folded back around the outer perimeter edges of interlayer 18 and inner glass ply 12. Connector 32 is sandwiched between surface 120 of inner glass ply 12 and glue bead 35. Antenna connector 32 is conductively connected at 44 to the electronic device 50 which is grounded to the window frame near inner metal edge 11 of window flange 38.

Figure 3:
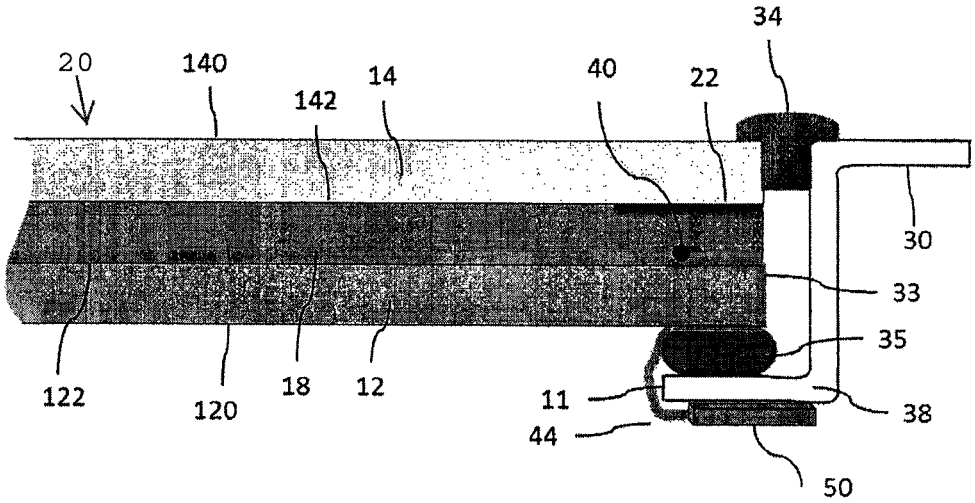
FIG. 3 is a sectional view taken along line A-A in FIG. 1 in accordance with the presently disclosed invention and illustrating an antenna feeding structure for an embedded wire antenna.

FIG. 3 illustrates another embodiment in which parts corresponding to those of the embodiment of FIGS. 1 and 2 are assigned reference characters corresponding to those of FIGS. 1 and 2. In FIG. 3, wire antenna 40 is fed by an antenna connector 33. Wire 40 is embedded in the surface of interlayer 18 that faces surface 122 of ply 12. Wire 40 is conductively connected to the metallic foil end of connector 33. Connector 33 exits the laminate at the outside perimeter edge of windshield 20 and is connected at 44 to an electronic module 50 that is connected to the chassis of the vehicle by an attachment device.

FIG. 4A is a top view of the disclosed antenna connector. The antenna connector includes a connector housing 331 and a flat flexible cable 340 (FIG. 4C). The side view of FIG. 4B shows three terminal pins (1, 2, 3) for the connector housing 331. In this embodiment, pin 2 of connector housing 331 is electrically connected to transmission line 330 that is located in cable 340 as more specifically shown in FIG. 4C and FIG. 5. Pins 1 and 3 are not used for antenna connection but used for mechanical support of the connector assembly in the drawings. FIG. 5 is a sectional view of the cable assembly 340 taken along line D-D in FIG. 4C. Flexible cable 340 has a base polymide (PI) layer 337 that is connected to all three pins of connector housing 331, a conductive transmission line 330 (such as copper trace printed on the base layer 337), and a cover tape 341 that is also connected to all 3 pins of connector housing 331 to insulate the copper trace 330. Flexible cable 340 further includes an adhesive layer 342 and corresponding protective backing paper 339 to secure the connector to the glass assembly during the lamination process, and a stiffener 336 for protecting the connection points between metallic trace 330 and the terminal pins.

Referring to FIGS. 4A-4C, the transmission line 330 (FIG. 5) (which can be made of copper, aluminum, tin, silver, or other conductive material) is composed of 4 portions. A first portion is a terminal portion 332 (FIG. 4A) that is conductively connected to terminal pin 2 of connector housing 331 (FIGS. 4A and 4B) by soldering or crimping. The connector housing 331 then is connected to an electronic device or a coaxial cable. A second portion of transmission line 330 is a wide trace portion 333 (FIG. 4A). A third portion of transmission line 330 is a thin trace portion 334 (FIG. 4A) that is partially laminated inside the windshield 20 (FIG. 1) and partially taped to the exterior surface of the windshield. The fourth portion is a pre-fluxed solder patch 335 (FIGS. 4A and 4B) that is laminated inside the windshield 20 and electrically connected to an antenna. The conductive trace 330 is the transmission line for transferring the antenna signal between an antenna situated inside the laminated glass and an electronic device or coaxial cable that is exterior to the glass.

The thinner metal trace 334 of transmission line 330 limits capacitive coupling between the metal trace and the vehicle grounding structure. The antenna impedance has a real component and reactive component, but only the real component results in radiation loss. For windshield imbedded wire antennas, there are limitations as to wire placement in the glass area. The limitations include aesthetics, obtrusiveness, and visibility. Therefore, most antenna wires are located out of the daylight area of the window and near the window frame grounding structure. This generally causes the impedance of the antenna to have a capacitive reactive component in the UHF band. The same applies for the IR coated slot antenna. A thin trace has self-inductance which partly offsets the capacitive reactance of the antenna impedance in the UHF band. Preferably, the connector is designed so that the inductance of thin trace 334 cancels out the capacitive reactance of the antenna. The inductance of thin trace 334 is a function of the cross-sectional area of the metal trace, the trace length, the operating frequency and the materials surrounding the metal trace.

The wider conductive trace 333 of transmission line 330 is capacitively coupled to vehicle ground body 30 (FIGS. 1 to 3) where the electronic device 50 (FIGS. 2 and 3) is mounted. The wider conductive trace 333 forms a shunt capacitor to the ground and tends to contribute to matching the antenna impedance across the VHF and UHF bands. Capacitance between trace 333 and ground flange 338 (FIG. 5) is determined by their interfacing area, the space between them measured in the normal direction, and the dielectric constant of the material between the trace 333 and the ground flange 338. Accordingly, the area of the interface and the normal dimension between trace 333 and ground flange 338 can be designed to match antenna impedance to transmission line impedance. This tends to minimize the net reactive component presented to the transmission line and thereby maximize radio frequency energy transfer in the VHF and UHF frequency bands.

Figure 6:
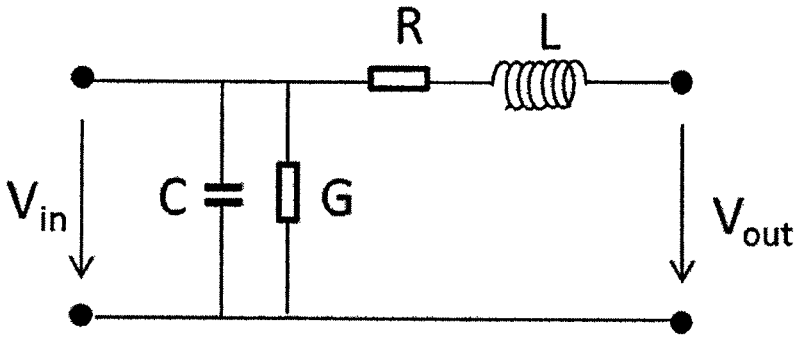
FIG. 6 is an equivalent circuit diagram for the antenna connector.

FIG. 6 is an equivalent circuit diagram that illustrates the equivalent resistance, conductance, inductance and capacitance of the antenna connector. Resistance R is connected in series with inductance L representing the equivalent resistance and self-inductance of the thinner trace 334 (FIG. 4A). The shunt capacitance C and conductance G are shunt to the ground representing the equivalent capacitance and conductance of wider trace 333. $V_{in}$ and $V_{out}$ are the input and output voltage of the transmission line, respectively. For a low loss structures such as a copper trace on a polymide substrate, the inductance L has a greater value than that of resistance R with respect to the radio frequencies. On the other hand the value of the capacitive susceptance C is also much greater than the shunt conductance G. So, ignoring R and G, the impedance model for the antenna connector can be expressed as a matching LC network.

In the presently disclosed invention, the antenna connector described herein is not only simple in construction and easy to manufacture, but has capability for antenna tuning and impedance matching. The antenna matching LC network is tunable. Its capacitance and inductance can be adjusted to match the antenna impedance to the input impedance of an electronic device or a coaxial cable which is typically 50Ω at resonate frequencies. The inductance of the antenna connector is adjusted by changing the length and cross-sectional area of metal trace 334. The trace width can be from 0.01 mm to 1.0 mm with a 35 μm thick metal trace. For windshield TV antenna applications, a trace width between 0.1 mm and 0.3 mm was found to be a preferred range for the presently disclosed embodiment. The capacitance of the antenna connector is adjusted by changing the length, and/or the width of the wider trace 333 and/or its relative distance to the grounding flange. A preferred trace width between 4 mm to 12 mm has been found to be suitable for a windshield TV antenna application. The total length of the antenna connector can be optimized such that the LC network provides best antenna impedance matching in the operating frequency band under the selected location of the antenna connector exiting a window and the mount location of associated electronics, because the length of the antenna connector and its distance to the grounding flange affect the shunt capacitance of the LC network.

The invention described and illustrated herein represents a description of illustrative preferred embodiments thereof. It will be within the ability of one of ordinary skill in the art to make alterations or modifications to the present invention, such as through the substitution of equivalent materials or structure arrangements, or through the use of equivalent process steps, so as to be able to practice the present invention without departing from the spirit and scope of the appended claims.

What is claimed is:

1. A connector for an antenna in a transparent laminate, said transparent laminate being mountable in a frame and having at least one transparent ply with two oppositely-facing major surfaces that are separated by an outer peripheral edge, said connector comprising:

(a) a flexible base layer;

(b) an electrically conductive transmission line that is located on a surface of said base layer, said transmission line including, a first portion that is a terminal portion, a second portion that is electrically connected to said terminal portion, said second portion having a segment that is located opposite one of the major surfaces of said transparent ply, said second portion having a width that is designed in accordance with the impedance of the antenna, a third portion that is electrically connected to said second portion, said third portion having a segment that extends inwardly from the outer peripheral edge of said transparent ply and is located opposite the other of the major surfaces of said transparent ply from said segment of said second portion, said third portion also having a width that is less than the width of said second portion and a length that is selected in accordance with the impedance of the antenna, and a fourth portion that is an electrical connection between said third portion and the antenna.

2. The antenna connector of claim 1 further comprising an electrical insulating layer that covers said transmission line and the surface of said base layer on which the transmission line is located.

3. The connector of claim 2 further comprising adhesive tape that is connected to the electrical insulating layer and that secures the second portion to the one of the major surfaces of the transparent ply during lamination of the transparent laminate.

4. The connector of claim 2 wherein said electrical insulating layer comprises an insulating tape.

5. The connector of claim 1 wherein the length of said third portion has a length that is selected in accordance with the impedance of the antenna.

6. The connector of claim 1 wherein said third portion has a cross-sectional area that is selected in accordance with the impedance of the antenna.

7. The connector of claim 1 wherein the location of said second portion has a location with respect to the frame that is selected in accordance with the impedance of the antenna.

8. The connector of claim 1 wherein said transmission line comprises a metallic conductor that is printed on said base layer.

9. The connector of claim 1 wherein said fourth portion is a solder patch.

10. The connector of claim 1 wherein the terminal portion of said transmission line includes at least one connector terminal.

11. The connector of claim 10 further comprising a stiffener that is coupled to said transmission line to protect said at least one connector terminal of said terminal portion.

12. The connector of claim 1 further comprising a housing that at least partially surrounds the terminal portion of said transmission line.

13. An antenna connector that provides impedance matching for an electronic device that receives signals from an antenna in a transparency laminate, said antenna connector comprising:

a flexible cable that includes:

a base layer;

an electrically conductive transmission line that is printed on a surface of said base layer, said transmission line having one end that is connectable to the antenna and a second end that includes at least one connector terminal; and a tape that is applied to said electrically conductive transmission line and the surface of said base layer, said tape electrically insulating said transmission line and said base layer;

a housing that is connectable to said at least one connector terminal of said flexible cable such that said transmission line conducts signals between the antenna and said electronic device at times when said housing is electrically connected to said electronic device, said housing providing mechanical and electrical protection to said at least one connector terminal at times when said housing it is connected thereto;

an adhesive tape with protective backing paper that is adhered to the tape of said flexible cable, said adhesive tape being used to secure a portion of the antenna connector to one side of the transparency laminate during a lamination process, and a stiffener that is mounted on said base layer to protect the connector terminals of said transmission line.

14. The antenna connector of claim 13 wherein said transmission line comprises:

a terminal portion that is conductively connected to a terminal pin by soldering or crimping;

a first metal trace section that has a first width;

a second metal trace section that has a width that is less than said first width;

a solder patch that is galvanically connectable to the antenna.

15. The antenna connector of claim 14 wherein the antenna transparency laminate is mounted in a frame and said first metal trace section defines an interfacing area between said first metal trace section and said frame, the capacitance between said first metal trace section and the frame being determined by said interfacing area, the normal dimension between the first metal trace section and the frame, and the dielectric constant of the material between the first metal trace section and the frame.

16. The antenna connector of claim 15 wherein the interfacing area of the first metal trace section and the frame, the normal dimension between the first metal trace section and the frame, and the dielectric constant of the material between the first metal trace section and the frame are selected such that the capacitance between the first metal trace section and the frame causes the impedance of the transmission line to tend to match the impedance of the antenna and limit the net reactive component of the impedance of the antenna and improve efficiency of the antenna.

17. The antenna connector of claim 14 wherein the transparency laminate is mounted in a frame and wherein said second metal trace section is sized to offset capacitive coupling between said antenna connector and the frame.

18. The antenna connector of claim 14 wherein the transparency laminate is mounted in a frame and wherein said first metal trace section is capacitively coupled to the frame in a manner that is electrically equivalent to a shunt capacitor to the frame.

19. The antenna connector of claim 14 wherein the second metal trace section has electrical inductance that is a function of the cross-sectional area of the second metal trace, the length of the second metal trace section, and the frequency of the signals that are conducted through the second metal trace section.

20. The antenna connector of claim 19 wherein the electrical inductance of said second metal trace section partially offsets the capacitive reactance of the antenna impedance at signal frequencies in the UHF band.

21. The antenna connector of claim 13 wherein said the transmission line is a conductive material selected from the group comprising copper, aluminum, silver, and tin.

22. The antenna connector of claim 13 wherein the second metal trace section is adapted to offset electrical impedance of the antenna wherein the impedance of the antenna has a reactive component that is capacitive in the UHF band.

23. The antenna connector of claim 13 wherein the equivalent electrical circuit of said antenna connector is a matching LC network.

24. The antenna connector of claim 23 wherein the total length of said antenna connector is selected such that said LC network matches antenna impedance at the operating frequency band under the selected location of said antenna connector and the mount location of the electronic device.

25. The antenna connector of claim 23 wherein the capacitance and inductance of said matching LC network are adjustable to match the antenna impedance to the input impedance of the electronic device.

26. The antenna connector of claim 25 wherein said second metal trace section is 35 μm thick and has width in the range of 0.01 mm to 1.0 mm.

27. The antenna connector of claim 25 for TV antenna application wherein said second metal trace section is 35 μm thick and has width in the range of 0.1 mm to 0.3 mm.

28. The antenna connector of claim 25 for TV antenna application wherein said first metal trace section has a width in the range of 4 mm to 12 mm.

* * * * *